US008056740B2

(12) United States Patent
Weshler et al.

(10) Patent No.: US 8,056,740 B2
(45) Date of Patent: Nov. 15, 2011

(54) PRODUCT DISPLAY ASSEMBLY AND TESTER SECURITY APPARATUS

(75) Inventors: Benjamin S. Weshler, Old Westbury, NY (US); William Y. Stafford, Minnetrista, MN (US)

(73) Assignee: Target Brands, Inc., Minneapolis, MN (US)

( * ) Notice: Subject to any disclaimer, the term of this patent is extended or adjusted under 35 U.S.C. 154(b) by 681 days.

(21) Appl. No.: 12/154,792

(22) Filed: May 27, 2008

(65) Prior Publication Data

US 2009/0294390 A1 Dec. 3, 2009

(51) Int. Cl.
*A47G 29/087* (2006.01)

(52) U.S. Cl. ..... 211/119.003; 211/59.3; 340/568.1

(58) Field of Classification Search ..... 211/119.003, 211/59.3, 59.2, 4, 183, 184, 90.01, 90.02, 211/90.04, 134; 312/35, 61, 71; 108/60–61; 340/568.1–568.4; 24/584.1, 589.1, 3.13; 248/551; 221/279
See application file for complete search history.

(56) References Cited

U.S. PATENT DOCUMENTS 1,462,108 A * 7/1923 Holywell ..... 211/69.5
1,573,358 A 2/1926 Ross
1,739,730 A * 12/1929 Orthwine ..... 211/128.1
1,975,691 A 10/1934 Hibbs
1,992,712 A 2/1935 Mojonnier
2,984,488 A 5/1961 Kirchner
3,154,209 A 10/1964 Wilhite et al.
3,154,281 A 10/1964 Frank
3,482,709 A 12/1969 Larson
3,568,357 A 3/1971 Lebensfeld
3,900,112 A 8/1975 Azzi et al.
4,477,142 A 10/1984 Cooper et al.
4,486,169 A * 12/1984 Lewis ..... 431/253
4,540,222 A 9/1985 Burrell
4,620,489 A 11/1986 Albano
4,901,869 A * 2/1990 Hawkinson et al. ..... 211/59.3
4,938,442 A 7/1990 Mastrodicasa
5,059,053 A * 10/1991 Rose ..... 403/24
5,111,942 A * 5/1992 Bernardin ..... 211/59.3
5,124,685 A * 6/1992 Rankin ..... 340/568.2
5,207,150 A 5/1993 Wellman et al.
5,390,998 A 2/1995 Friedman (Continued)

OTHER PUBLICATIONS

Exhibit A, Wireless Phone Holder System with Pull Box (Tethered) believed to have been used publicly in Target stores before May 27, 2007.

(Continued)

*Primary Examiner* — Darnell Jayne
*Assistant Examiner* — Devin Barnett
(74) *Attorney, Agent, or Firm* — Nixon & Vanderhye P.C.

(57) ABSTRACT

A product display assembly having a tester security apparatus for at least one tester of a product, includes a base having a top surface, and at least one tester holder disposed on the top surface of the base, wherein each of the at least one tester holder is adapted for receiving and reversibly retaining a tester. The product display assembly includes at least one retractor each corresponding to the at least one tester holder disposed on the top surface of the base, wherein the retractor each has a retractable line located therein with a free end extending therefrom. The product display assembly further includes a fastening element adapted for attachment to the exterior of the tester, and a coupling member, wherein the coupling member further includes retaining means for receiving and retaining the free end of the retractable line of a corresponding retractor.

11 Claims, 5 Drawing Sheets

U.S. PATENT DOCUMENTS

| | | | | |
|---|---|---|---|---|
| 5,464,105 | A | 11/1995 | Mandeltort | |
| 5,595,310 | A * | 1/1997 | Spamer et al. | 211/59.2 |
| 5,622,010 | A | 4/1997 | Weber | |
| 5,673,801 | A * | 10/1997 | Markson | 211/59.3 |
| 5,685,436 | A * | 11/1997 | Davet | 211/85.5 |
| 5,749,478 | A | 5/1998 | Ellis | |
| 5,865,476 | A * | 2/1999 | Kramer | 285/242 |
| 5,873,641 | A | 2/1999 | Spinelli | |
| 5,878,895 | A * | 3/1999 | Springs | 211/59.3 |
| 5,926,922 | A * | 7/1999 | Stottle | 24/23 R |
| 5,975,318 | A | 11/1999 | Jay | |
| 5,984,439 | A | 11/1999 | Orr et al. | |
| 5,992,652 | A * | 11/1999 | Springs | 211/59.3 |
| 6,021,908 | A | 2/2000 | Mathews | |
| 6,161,708 | A | 12/2000 | Myler | |
| 6,168,032 | B1 * | 1/2001 | Merl | 211/59.2 |
| 6,290,077 | B2 | 9/2001 | Sosso | |
| D453,272 | S | 2/2002 | Meyer | |
| 6,357,609 | B1 | 3/2002 | Van Noord et al. | |
| 6,476,717 | B1 * | 11/2002 | Gross et al. | 340/568.1 |
| 6,497,461 | B1 | 12/2002 | Harian | |
| 6,543,095 | B2 * | 4/2003 | Sedlmeier | 24/20 R |
| 6,752,277 | B1 | 6/2004 | Sempliner | |
| 6,761,579 | B2 * | 7/2004 | Fort et al. | 439/501 |
| 7,124,897 | B2 | 10/2006 | Bustos | |
| 7,150,365 | B2 | 12/2006 | Hardy et al. | |
| 7,152,536 | B2 | 12/2006 | Hardy | |
| D540,566 | S | 4/2007 | Scholen et al. | |
| 7,201,440 | B2 | 4/2007 | Heck et al. | |
| 7,287,652 | B2 | 10/2007 | Scholen et al. | |
| 7,299,934 | B2 | 11/2007 | Hardy et al. | |
| 7,340,855 | B2 | 3/2008 | Wiltfang et al. | |
| 7,523,898 | B1 | 4/2009 | Barry et al. | |
| 7,587,796 | B1 * | 9/2009 | Schultz | 24/306 |
| 7,686,185 | B2 * | 3/2010 | Zychinski | 221/279 |
| 2001/0035385 | A1 * | 11/2001 | Sosso | 211/184 |
| 2002/0027115 | A1 * | 3/2002 | Gay et al. | 211/187 |
| 2002/0162201 | A1 * | 11/2002 | Liu | 24/598.5 |
| 2003/0205545 | A1 | 11/2003 | Moceri | |
| 2004/0050811 | A1 | 3/2004 | Leahy et al. | |
| 2004/0182805 | A1 | 9/2004 | Harper | |
| 2005/0082450 | A1 * | 4/2005 | Barrett et al. | 248/229.16 |
| 2005/0232682 | A1 * | 10/2005 | Aguirre et al. | 401/131 |
| 2005/0247649 | A1 * | 11/2005 | Scholen et al. | 211/26 |
| 2005/0263465 | A1 | 12/2005 | Chung | |
| 2006/0139170 | A1 * | 6/2006 | Ott | 340/568.2 |
| 2006/0273706 | A1 | 12/2006 | Champagne et al. | |
| 2007/0035699 | A1 * | 2/2007 | McKee | 352/90 |
| 2007/0085456 | A1 | 4/2007 | Farrens | |
| 2007/0144543 | A1 * | 6/2007 | Simon | 131/240.1 |
| 2007/0187346 | A1 | 8/2007 | Markson et al. | |
| 2010/0294896 | A1 | 11/2010 | Sayilgan | |

OTHER PUBLICATIONS

Stafford, William Y. et al., "Shelf Assembly," U.S. Design Application, filed Oct. 23, 2008 (8 pgs.).

Weshler, Benjamin, "Product Display Assembly and Tester Security Apparatus," U.S. Appl. No. 12/154,792, filed May 27, 2008 (25 pgs.).

Stafford , William Y, "Quick Secure Shelving"U.S. Appl. No. 12/257,252, filed Oct. 23, 2008.

* cited by examiner

PRODUCT DISPLAY ASSEMBLY AND TESTER SECURITY APPARATUS

FIELD OF THE INVENTION

The present invention relates generally to product displays for consumer goods and products, and more particularly to a product display assembly adapted for securing one or more testers of a product to allow consumers to test or sample the product prior to purchase.

BACKGROUND OF THE INVENTION

Product displays have been used by retailers in the sale of goods or products from fixed locations such as a boutique shop, department or discount stores or kiosk. Such product displays are typically utilized in conjunction with shelves for holding a large number of products and maintaining the products in an orderly, upright arrangement to provide a visually pleasant appearance. For product displays of products such as cosmetics, it is often expected to provide access to testers for sampling or testing by the consumer prior to purchase of the product. Unfortunately, the testers are often stolen or shoplifted, thus requiring constant restocking of the testers.

Efforts have been made to enhance the security of the testers against such theft or shoplifting through the use of electronic sensing devices or locks for fixing the tester on the product display to prevent removal. Such product displays are more complicated and costly to fabricate and implement, and accommodate only a limited range of products or display requirements. The existing security mechanisms used to protect the testers are frequently obtrusive and detract from the appearance of the product and the product display. They also undesirably interfere with convenient handling and use of the testers by the consumer.

Accordingly, there continues to be a need for a product display assembly with a tester security apparatus for at least one tester of a product that enables consumers to freely handle and use the tester for testing or sampling the associated product in a more convenient manner prior to purchase. There is a need for a product display assembly with a tester security apparatus for at least one tester of a product, designed to effectively protect the tester from theft or shoplifting without encumbering the appearance of the product display or the tester itself. There is a need for a product display assembly with a tester security apparatus for at least one tester of a product, designed to accommodate testers of various dimensions, while being simple and cost effective to make and use.

SUMMARY OF THE INVENTION

The present invention relates generally to a product display assembly having one or more testers for a product, and a tester security apparatus for securing the testers. The product display assembly of the present invention is designed to display products in an attractive manner that is conducive to sale, and enhance visibility and access to the products. The product display assembly and the tester security apparatus of the present invention are further adapted to provide consumers with ease of access and convenient use of the testers, while deterring theft or shoplifting. The product display assembly and the tester security apparatus of the present invention are further designed to minimize the appearance of security systems without sacrificing functionality. The product display assembly and tester security apparatus of the present invention are simple, cost effective and highly reliable, while being readily configurable to accommodate a range of products and display requirements.

In one aspect of the present invention, there is provided a product display assembly having at least one tester for a product, comprising:

a base having a top surface;

at least one tester holder disposed on the top surface of the base, each of the at least one tester holder adapted for receiving and reversibly retaining a tester;

at least one retractor each corresponding to the at least one tester holder disposed on the top surface of the base, the retractor each having a retractable line located therein with a free end extending therefrom;

a fastening element adapted for attachment to the exterior of the tester, the fastening element further adapted to form a tab portion extending away from the tester upon attachment to the tester; and a coupling member adapted for operative engagement with the tab portion of the fastening element, the coupling member further including retaining means for receiving and retaining the free end of the retractable line.

In another aspect of the present invention, there is provided a tester security apparatus for securing a tester, comprising:

a fastening element adapted for attachment to the exterior of the tester, the fastening element further adapted for forming a tab portion extending away from the tester upon attachment to the tester; and a coupling member adapted for operative engagement with the tab portion of the fastening element, the coupling member further including retaining means for receiving and retaining the end of a retractable line extending from a retractor.

BRIEF DESCRIPTION OF THE DRAWINGS

The following drawings are illustrative of embodiments of the present invention and are not intended to limit the invention as encompassed by the claims forming part of the application.

DETAILED DESCRIPTION OF THE INVENTION

Figure 1:
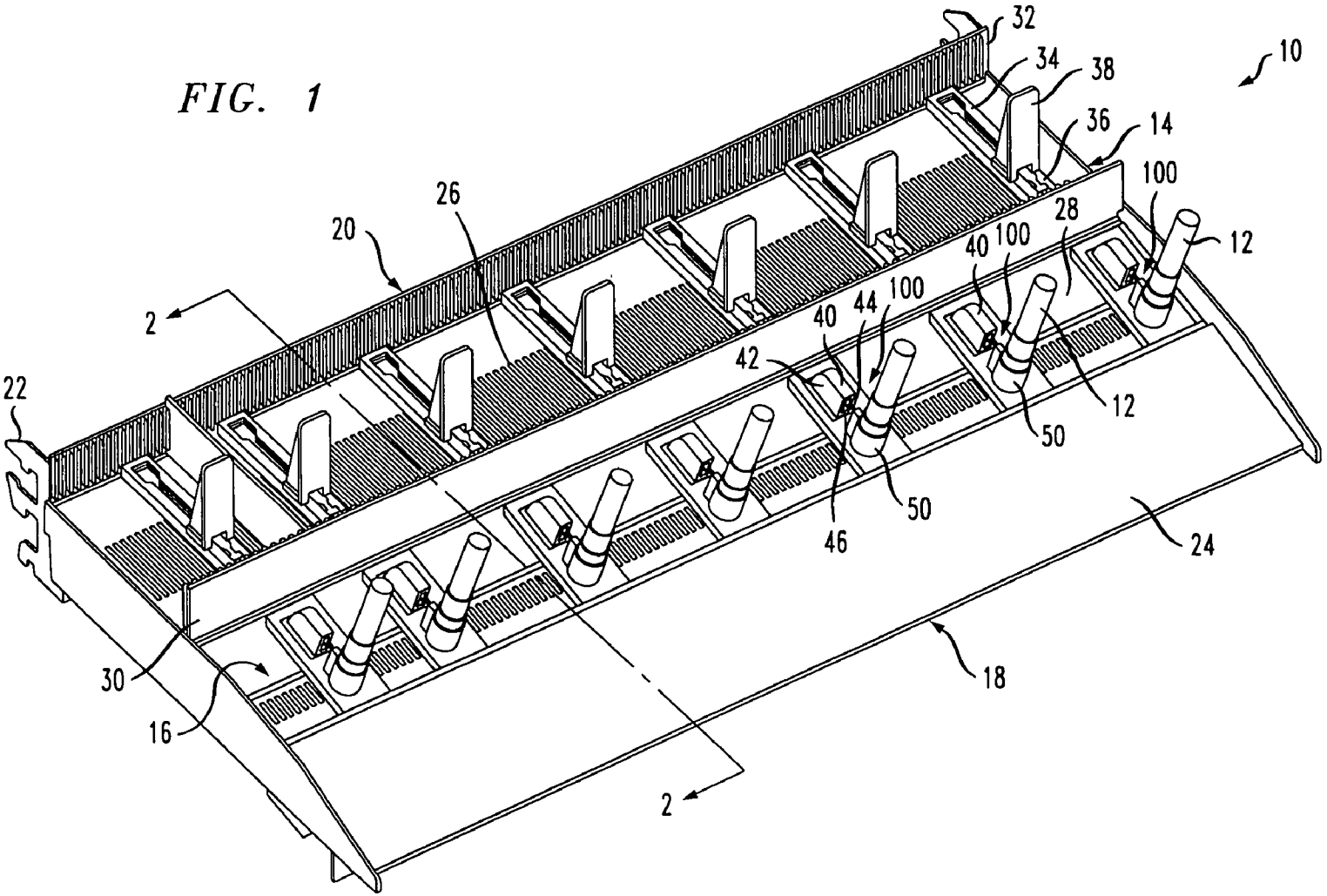
FIG. 1 is a perspective view of a product display assembly in accordance with one embodiment of the present invention.

The present invention is directed to a product display assembly having one or more testers for a product, and a tester security apparatus for securing the testers. The product display assembly of the present invention is designed to display products in an attractive manner that is conducive to sale, and enhance visibility and access to the products. The product display assembly and the tester security apparatus of the present invention are further adapted to provide consumers with ease of access and convenient use of the testers, while deterring theft or shoplifting. The product display assembly and the tester security apparatus of the present invention are further designed to minimize the appearance of security systems without sacrificing functionality. The product display assembly and tester security apparatus of the present invention are simple, cost effective and highly reliable, while being readily configurable to accommodate a range of products and display requirements.

In one embodiment of the present invention, there is provided a product display assembly having at least one tester for a product, which comprises a base having a top surface, and at least one tester holder disposed on the top surface of the base, wherein each of the at least one tester holder is adapted for receiving and reversibly retaining a tester. The product display assembly includes at least one retractor each corresponding to the at least one tester holder disposed on the top surface of the base, wherein the retractor each has a retractable line located therein with a free end extending therefrom.

The product display assembly further includes a fastening element adapted for attachment to the exterior of the tester, wherein the fastening element is further adapted to form a tab portion extending away from the tester upon attachment to the tester, and a coupling member adapted for operative engagement with the tab portion of the fastening element, wherein the coupling member further including retaining means for receiving and retaining the free end of the retractable line of a corresponding retractor.

In another embodiment of the present invention, there is provided a tester security apparatus for securing a tester, which comprises a fastening element adapted for attachment to the exterior of the tester, wherein the fastening element is further adapted for forming a tab portion extending away from the tester upon attachment to the tester. The tester security apparatus further comprises a coupling member adapted for operative engagement with the tab portion of the fastening element, wherein the coupling member further includes retaining means for receiving and retaining the end of a retractable line extending from a retractor.

As used herein, the term "tester" refers to an article or item not intended for sale or distribution to the consumer, and representing a particular product, which is offered to a consumer as a means to test or sample the particular product. The tester may be in the form of a cosmetic such as lipsticks, foundations, concealers, blush, eyeliners, nail polishes, eye shadows, creams, lotions, sprays, perfumes, gels, oils, and the like. It will be understood that the tester is not limited to cosmetics, and may encompass any goods or products.

Figure 2:
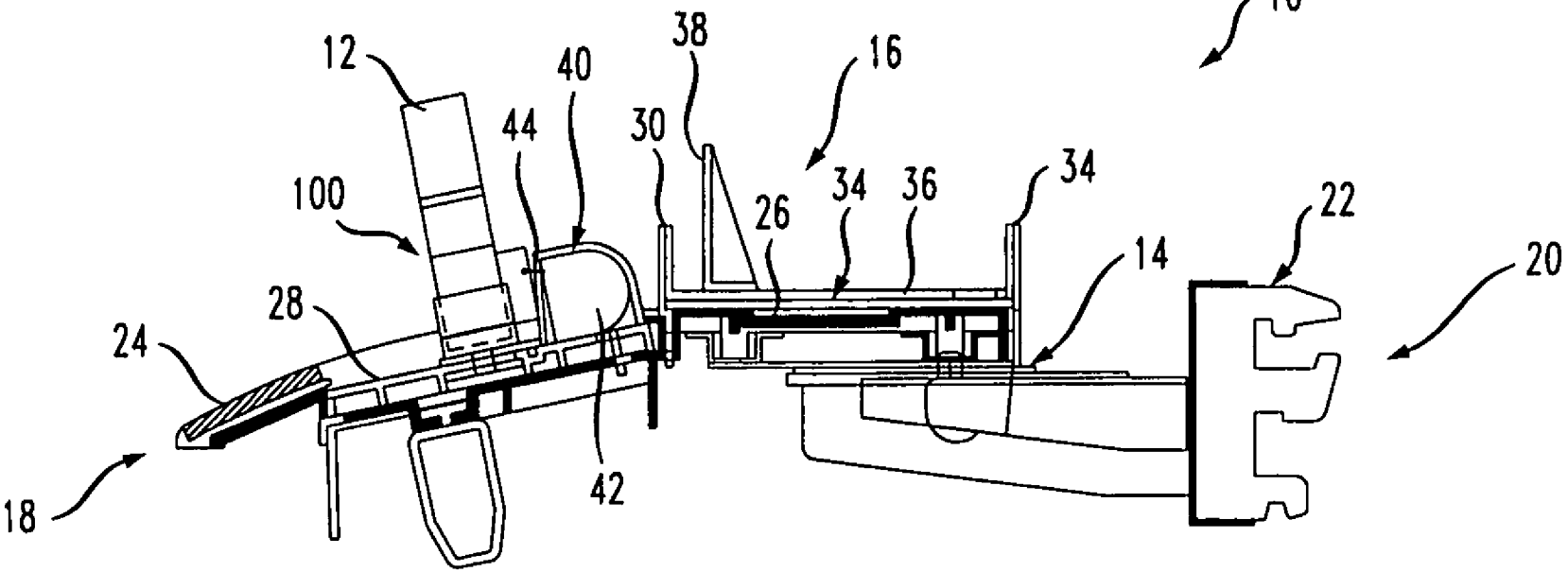
FIG. 2 is cross section view of the product display assembly along line 2-2 of FIG. 1 in accordance with the present invention.

Referring to FIGS. 1 and 2, a product display assembly identified generally by reference numeral 10 is shown for one embodiment of the present invention. The product display assembly 10 is designed to secure one or more testers 12 of various sizes and shape in an inconspicuous manner, and optionally hold products including, but not limited to, cosmetics for sale or distribution to the consumer. The testers 12 allow the consumers to test or sample a particular product prior to purchase. The product display assembly 10 includes one or more tester security apparatuses 100 for securing the testers 12 thereto. Each of the tester security apparatuses 100 is operatively engaged to a corresponding tester 12 to enable the consumer to freely handle and use the tester 12, while deterring theft or shoplifting as will be further described hereinafter.

The product display assembly 10 includes a base or tray 14 having a top surface 16 on which the testers 12 and the tester security apparatuses 100 are retained. The base 14 includes a front end 18 and a rear end 20, an information display area 24 located proximate the front end 18 thereof, a product area 26 located proximate the rear end 18 thereof, a tester area 28 disposed between the information display area 24 and the product area 26, and a wall mountable carrier assembly 22 located on the rear end 20 thereof. The base 14 further includes a front fence 30 and a rear fence 32 bounding the product area 26. The information display area 24 is adapted to support and display to the consumer information corresponding to the product displayed. The consumer information may be presented in the form of electronic displays, printed indicia, drawings, pictures, illustrations, graphics, and the like.

The product area 26 of the base 14 is adapted to hold one or more products offered for sale or distribution to the consumer. The product area 26 provides a well-organized space for displaying the products in an aesthetically pleasing manner and drawing the consumer's attention to the product displayed, while facilitating ease of restocking of product. The product area 26 includes one or more pusher mechanisms 34 for retaining the products thereon. The pusher mechanisms 34 each include a pusher track 36 and a spring-biased pusher 38 slidably mounted on the pusher track 36 for slidably moving back and forth. The pusher track 36 is securely mounted to the base 14 with the pusher 38 biased via a spring (not shown) towards the front end 18 of the base 14. The products are retained in juxtaposition with one another within the area between the pusher 38 and the front fence 30. The retained products are constantly urged forward via the pusher 38 as the products are removed therefrom.

The tester area 28 of the base 14 is adapted to present the testers 12 to the consumer, includes one or more retractors or reels 40 and corresponding one or more tester holders or cups 50, each of which are securely mounted to the base 14. The tester holders 50 are each located proximate to a corresponding retractor 40, and configured to hold a tester 12 in a conspicuous manner during storage as will be described hereinafter. Preferably, the tester holders 50 are positioned proximate to the front end 18 of the base 14 to ensure that the tester 12 is visibly associated with the information display area 24. Each retractor 40 is located behind the corresponding holders 50 to provide an inconspicuous appearance. The retractors 40 include a retractable line 44 that extend therefrom for attachment to the tester 12 via the tester security apparatus 100 as will be described hereinafter. In this manner, the retractor 40 allows the consumer to remove from the tester holder 50 and handle the tester 12 during use, while ensuring that the tester 12 remains attached to the product display assembly 10.

Figure 3:
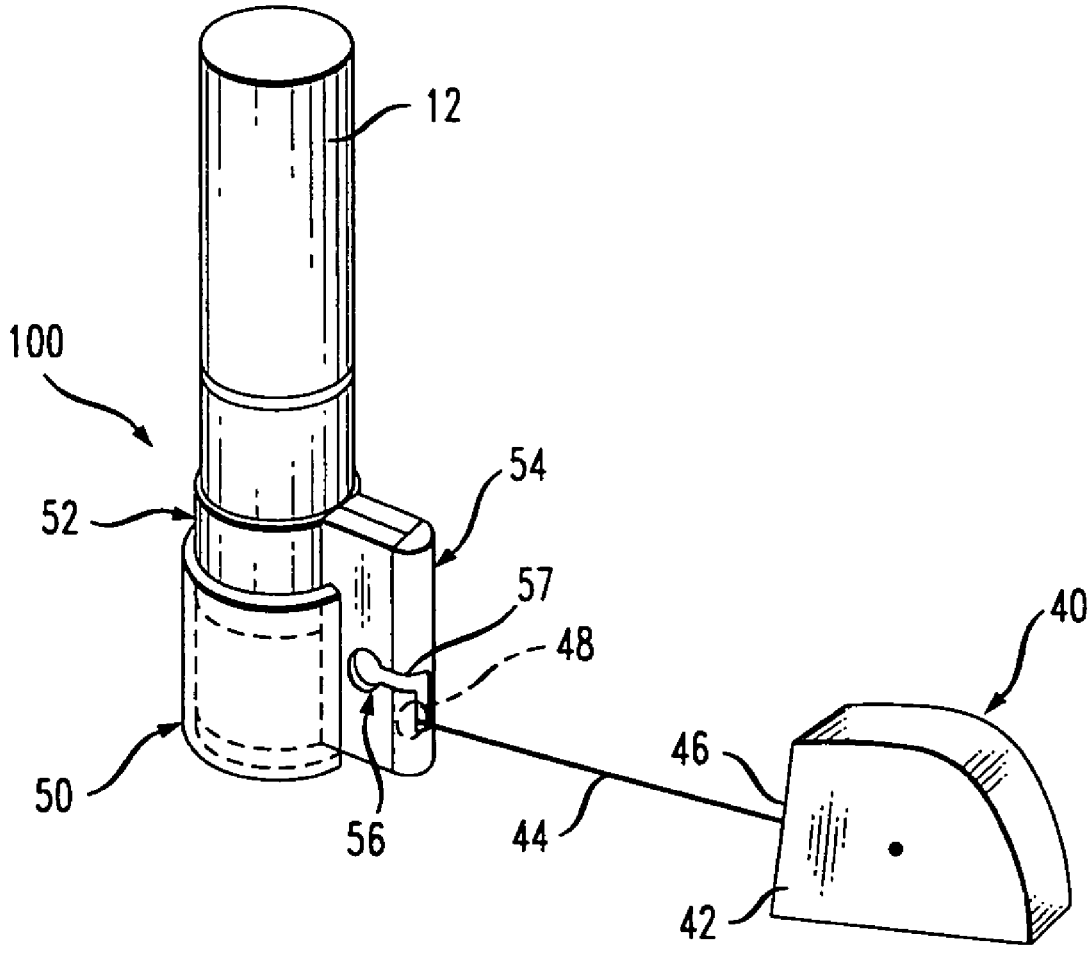
FIG. 3 is a perspective view of a tester security apparatus forming part of the product display assembly of FIG. 1, shown in combination with a tester and a retractor in accordance with the present invention.
Figure 4:
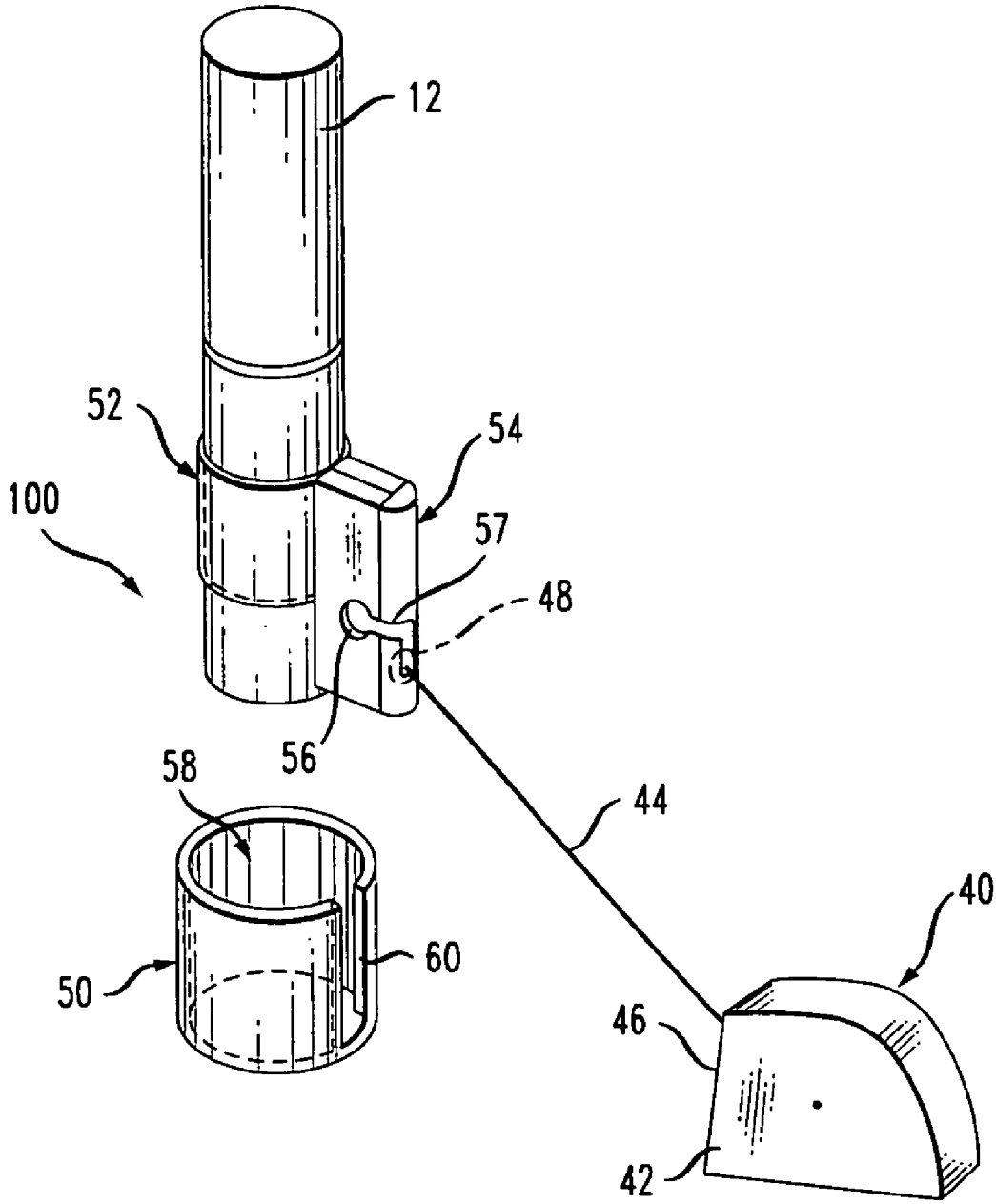
FIG. 4 is a perspective view of the tester security apparatus shown with the tester removed from the tester holder in accordance with the present invention.

Referring to FIGS. 3 and 4, the tester 12 is shown attached to the retractor 40 through the tester security apparatus 100. The retractor 40 includes a housing 42, a cylindrical core (not shown) around which an elongate flexible line 44 is wound within the housing 42, a spring mechanism (not shown) operatively engaged to the cylindrical core (not shown) for spring-biasing the line 44 to a retracted state, and an opening 46 through which the free end of the line 44 extends. The line 44 includes a ball-shaped bead or knob 48 disposed on the free end thereof (as shown best in FIG. 5). The tester security apparatus 100 is attached to the retractor 40 via the ball-shaped bead or knob 48 of the line 44 with the tester 12 secured to the product display assembly 10 through the tester security apparatus 100.

The tester security apparatus 100 includes a fastening element 52 extending around the exterior of the tester 12, and a coupling member 54 operatively engaged to the fastening element 52. Preferably, the fastening element 52 is a flexible material, and more preferably in the form of a flexible transparent strip. The fastening element 52 may be composed of any suitable material selected from paper, film, cloth, metal foil, foam, and plastics including, but not limited to, acetates.

The fastening element 52 further includes an adhesive substance such as an acrylic adhesive to form an adhesive bond with the exterior surface of the tester 12, thereby providing a secure adhesive attachment therebetween as will be further described hereinafter. An example of a suitable fastening element is VHB™ Acrylic Foam Tape, which is commercially available from 3M Company of St. Paul, Minn.

It will be understood by one skilled in the art that the form of the fastening element 52 is not limited to a flexible material, and may encompass any mechanical fastener adapted to form a tab portion extending away from the tester upon attachment to the tester, including those utilizing various attachment techniques such as welding, crimping, soldering, brazing, taping, cementing, suction, friction, magnets, and the like.

The coupling member 54, which is securely engaged to the fastening element 52, includes an aperture 56 with a slot 57 at the end distal from the tester 12, and an interior cavity (not shown) in communication with the aperture 56 and the slot 57. Preferably, the coupling member 54 is positioned on the rear side of the tester 12 to ensure an inconspicuous appearance. The interior cavity of the coupling member 54 is configured for receiving the ball-shaped bead 48 through the aperture 56. The slot 57 accommodates the line 44 to retain the ball-shaped bead 48, thereby providing a secure reversible attachment of the tester 12 to the line 44. At a subsequent time such as to replace the tester 12, the line 44 can readily be disengaged from the coupling member 54 of the tester security apparatus 100 by removing the bead 48 from the interior cavity (not shown) through the aperture 56.

As shown in FIG. 4, the tester 12 is readily removable from the tester holder 50 by moving the tester 12 vertically upward. The bead 48 of the line 44 remains in the coupling member 54 as the retractor 40 releases the line 44, thus ensuring a secure attachment. The tester holder 50 includes a holding area 58 for receiving the lower end of the tester 12, and a side opening 60 for accommodating the coupling member 54 with the tester 12 securely seated in the holding area 58. The side opening 60 of tester holder 50 ensures that the tester 12 is oriented properly for display. The tester security apparatus 100 and the retractor 40 effectively operate to prevent the consumer from inadvertently keeping the tester 12 and offers sufficient deterrence against theft, while allowing the consumer to freely handle the tester 12.

Figure 5:
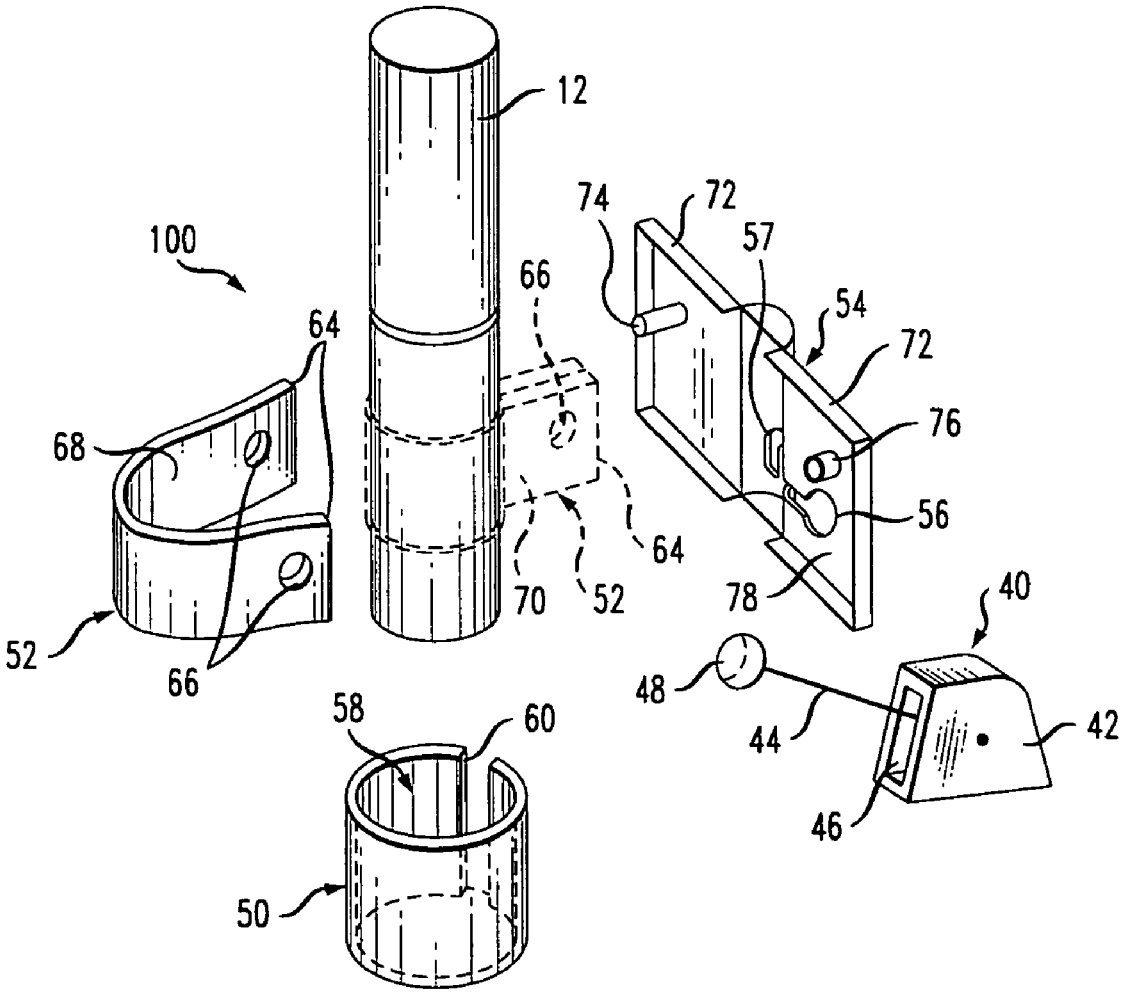
FIG. 5 is an assembly view of the tester security apparatus shown with the tester in accordance with the present invention.

Referring to FIG. 5, an assembly view of the tester security apparatus 100 and the tester 12 in combination with the retractor 40 is shown. The fastening element 52 in the form of a transparent strip, includes an adhesive inside surface 68 and a pair of holes 66 each located at opposing ends 64 thereof. The fastening element 52 is mounted onto the tester 12 (as shown in phantom). The adhesive inside surface 68 of the fastening element 52 adhesively contacts the exterior of the tester 12 as the opposing ends 64 of the fastening element 52 adhesively meets to form a tab portion 70 (as shown in phantom) with the hole 66.

The coupling member 54 includes a pair of opposing side members 72 hingedly connected to one another. The side members 72 are configured to move toward one another from an open state to a closed state. The coupling member 54 includes an interior portion 78 defined by the opposing side members 72 in the closed state for retaining the tab portion 70 of the fastening element 52 therein, and a locking mechanism (not shown) for locking the opposing members together in the closed state.

The coupling member 54 includes a rod 74 in one side member 72, and a socket 76 adapted to receive and retain the rod 74 in the other side member 72. The coupling member 54 is attached to the tab portion 70 of the fastening element 52 (as shown in phantom) by passing the rod 74 through the hole 66 and into the socket 76 during closure thereof. The rod 74 and the socket 76 may be configured to form a locking engagement therebetween upon mating, thereby providing a suitable locking mechanism. Once locked in the closed state, the coupling member 54 is securely attached to the fastening element 52. Preferably, the locking of the side members 72 to one another is irreversible.

With reference to FIGS. 1-5, the operation of the product display assembly 10 and the tester security apparatus 100 will now be described. The consumer selects the tester 12 from the tester area 28 for testing or sampling a particular product, and retrieves the selected tester 12 from the tester holder 50. As the tester 12 moves away from the tester holder 50, the retractor 40 releases the line 44 to allow the consumer to freely handle and use the tester 12.

Once the testing is complete, the consumer returns the tester 12 to the product display assembly 10. The retractor 40 automatically draws back the line 44 and directs the tester 12 toward the proper tester holder 50. As the tester 12 returns to the holding area 58, the coupling member 54 slides into the side opening 60 of the tester holder 50 to ensure proper placement and orientation of the tester 12. When the tester 12 is properly seated within the tester holder 50, the tester 12 is ready for use. If the consumer is satisfied with the tester 12, the consumer may take one of the products from the product area 26 for purchase.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A product display assembly for securing one or more testers of one or more products to a base, the product display assembly comprising:

at least one tester for the products;

a base having a top surface defining a tester area;

at least one tester holder disposed in the tester area of the base, each of said at least one tester holder adapted for receiving and retaining said at least one tester;

at least one retractor each corresponding to said at least one tester holder disposed proximate to said at least one tester holder in the tester area of the base, said at least one retractor each having a retractable line located therein with a free end extending therefrom;

a fastening element attached to the exterior of the at least one tester, said fastening element comprising a strip having first and second ends, the strip extending peripherally along the exterior of the at least one tester, wherein the first and second ends thereof are connected to define a tab portion extending away from the at least one tester; and a coupling member engaging the tab portion of the fastening element, said coupling member further including retaining means for receiving and retaining the free end of the retractable line of said at least one retractor, wherein the retaining means comprises an aperture in communication with the interior portion of the coupling member, said aperture including a slot portion having a width less than the diameter of the aperture, wherein the coupling member comprises a pair of opposing side members comprising a first side member and a second side member which are hingedly connected to each other, said opposing side members being connected to and sandwiching the tab portion, and locking means located within an interior portion of the coupling member for irreversibly locking the opposing members together, wherein the locking means includes a rod extending from the first side member toward the second side member in a closed position and a socket extending from the second side member which is adapted to receive and retain the rod of the first side member, wherein the tab portion of the fastening element includes a hole extending therethrough and the rod extends through said hole and into said socket in the closed position.

2. The product display assembly of claim 1 wherein the base comprises:

a front end and a rear end;

an information display area located on the top surface proximate the front end of the base, said information display area including printed indicia;

a product area located on the top surface proximate the rear end of the base, said product area adapted for holding one or more products associated with the at least one tester; and the tester area disposed between the information display area and the product inventory area.

3. The product display assembly of claim 2, further comprising at least one pusher mechanism disposed on the product area, said pusher mechanism adapted for urging said products forward in a constant manner, upon removal of the products from the product area.

4. The product display assembly of claim 1 wherein the fastening element is further adapted for adhesive attachment around the exterior of the at least one tester.

5. The product display assembly of claim 4 wherein the fastening element comprises an adhesive surface disposed on a side thereof facing the exterior of the at least one tester.

6. The product display assembly of claim 1 wherein the fastening element is transparent.

7. A tester security apparatus for securing a tester to a base having a top surface, the tester security apparatus comprising:

a fastening element attached to the exterior of a tester, said fastening element comprising a strip having first and second ends, the strip extending peripherally along the exterior of the tester, wherein the first and second ends thereof are connected to define a tab portion extending away from the tester;

a coupling member engaging the tab portion of the fastening element, said coupling member further including a retaining structure sized and shaped to secure the end of a retractable line extending from a retractor disposed securely on said base, wherein the coupling member comprises a pair of opposing side members comprising a first side member and a second side member which are hingedly connected to each other, said opposing side members being connected to and sandwiching the tab portion, and locking means located within an interior portion of the coupling member for irreversibly locking the opposing members together, wherein the locking means includes a rod extending from the first side member toward the second side member in a closed position and a socket extending from the second side member which is adapted to receive and retain the rod of the first side member, and wherein the tab portion of the fastening element includes a hole extending therethrough and the rod extends through said hole and into said socket in the closed position; and a tester holder disposed securely on said base, said tester holder being adapted for receiving and retaining the tester and including a vertical slot therein that is sized and shaped to receive the tab portion and the coupling member.

8. The tester security apparatus of claim 7 wherein the fastening element is attached around the exterior of the tester with an adhesive.

9. The tester security apparatus of 7 wherein the retaining structure comprises an aperture in communication with the interior portion of the coupling member, said aperture including a slot portion having a width less than the diameter of the aperture.

10. The tester security apparatus of claim 8 wherein the fastening element is a flexible strip.

11. The tester security apparatus of claim 10 wherein the fastening element is transparent.

* * * * *